US012426679B2

(12) United States Patent
Connell et al.

(10) Patent No.: US 12,426,679 B2
(45) Date of Patent: Sep. 30, 2025

(54) ARTICLE OF FOOTWEAR WITH STACKED FOREFOOT BLADDERS

(71) Applicant: NIKE, Inc., Beaverton, OR (US)

(72) Inventors: Jeremy L. Connell, Portland, OR (US); Jason R. Meeker, Hillsboro, OR (US); Jason G. Petrie, Portland, OR (US); Jacob Raymond Van Daam, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/355,424

(22) Filed: Jul. 20, 2023

(65) Prior Publication Data

US 2024/0074533 A1 Mar. 7, 2024

Related U.S. Application Data

(60) Provisional application No. 63/403,027, filed on Sep. 1, 2022.

(51) Int. Cl.
*A43B 13/18* (2006.01)

(52) U.S. Cl.
CPC ..... *A43B 13/187* (2013.01)

(58) Field of Classification Search
CPC ..... A43B 13/20; A43B 13/189; A43B 13/203; A43B 13/206; A43B 13/186; A43B 13/125
See application file for complete search history.

(56) References Cited

U.S. PATENT DOCUMENTS

| | | | |
|---|---|---|---|
| 2,677,906 | A | 5/1954 | Reed |
| 3,291,085 | A | 12/1966 | Levy |
| 3,431,570 | A | 3/1969 | Murphy |
| 3,475,836 | A | 11/1969 | Brahm |
| 3,593,436 | A | 7/1971 | Vietas |
| 4,183,156 | A | 1/1980 | Rudy |
| 4,219,945 | A | 9/1980 | Rudy |
| 4,367,599 | A | 1/1983 | Diamant |
| 4,809,447 | A | 3/1989 | Pacanowsky et al. |
| 4,936,029 | A | 6/1990 | Rudy |
| 5,042,176 | A | 8/1991 | Rudy |
| 5,664,343 | A | 9/1997 | Byrne |

(Continued)

FOREIGN PATENT DOCUMENTS

| | | | |
|---|---|---|---|
| CN | 1206571 | A | 2/1999 |
| CN | 1731942 | A | 2/2006 |

(Continued)

*Primary Examiner* — Khoa D Huynh
*Assistant Examiner* — Grady Alexander Nunnery
(74) *Attorney, Agent, or Firm* — Quinn IP Law

(57) ABSTRACT

An article of footwear has a sole structure that includes a foam midsole layer. A first forefoot cushioning component is secured to the foot-facing surface of the foam midsole layer in the forefoot region, a second forefoot cushioning component overlies the first forefoot cushioning component, and a strobel extends at least in the forefoot region and the midfoot region and over the second forefoot cushioning component. One or more of the forefoot cushioning component, the second forefoot cushioning component, and the strobel may include a bladder and a tensile component. The bladder encloses and retains a gas in an interior cavity. The tensile component is disposed in the interior cavity.

19 Claims, 5 Drawing Sheets

(56) References Cited

U.S. PATENT DOCUMENTS

| | | | | |
|---|---|---|---|---|
| 5,933,983 | A * | 8/1999 | Jeon | A43B 21/28 36/35 B |
| 6,013,340 | A | 1/2000 | Bonk et al. | |
| 6,082,025 | A | 7/2000 | Bonk et al. | |
| 6,119,371 | A | 9/2000 | Goodwin et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,385,864 | B1 | 5/2002 | Sell, Jr. et al. | |
| 6,463,612 | B1 * | 10/2002 | Potter | A43B 13/20 36/43 |
| 6,837,951 | B2 | 1/2005 | Rapaport | |
| 7,055,267 | B2 | 6/2006 | Wilson et al. | |
| 7,244,483 | B2 | 7/2007 | Tawney et al. | |
| 7,588,654 | B2 | 9/2009 | Schindler et al. | |
| 7,591,919 | B2 | 9/2009 | Schindler et al. | |
| 7,752,772 | B2 | 7/2010 | Hatfield et al. | |
| 8,464,439 | B2 | 6/2013 | Monfils et al. | |
| 8,595,956 | B2 | 12/2013 | Byrne | |
| 8,800,166 | B2 | 8/2014 | Monfils et al. | |
| 8,839,530 | B2 | 9/2014 | Smith et al. | |
| 9,072,336 | B2 | 7/2015 | Borel et al. | |
| 9,119,440 | B2 | 9/2015 | Lagneau et al. | |
| 9,226,548 | B2 | 1/2016 | Follet et al. | |
| 9,380,837 | B2 | 7/2016 | Chon et al. | |
| 9,427,043 | B2 | 8/2016 | Kodad | |
| 9,445,649 | B2 | 9/2016 | Huffa et al. | |
| 9,468,258 | B2 | 10/2016 | Ruiz et al. | |
| 9,474,326 | B2 | 10/2016 | Langvin | |
| 9,730,487 | B2 | 8/2017 | Davison | |
| 9,801,428 | B2 | 10/2017 | Taylor et al. | |
| 9,894,959 | B2 | 2/2018 | Taylor et al. | |
| 10,694,814 | B2 | 6/2020 | Bailey et al. | |
| 10,863,792 | B2 | 12/2020 | Auyang et al. | |
| 11,044,964 | B2 | 6/2021 | Meeker | |
| 2003/0163880 | A1 | 9/2003 | Keidel et al. | |
| 2003/0200675 | A1 * | 10/2003 | Gross | A43B 13/36 36/15 |
| 2004/0049942 | A1 | 3/2004 | Chen | |
| 2005/0097777 | A1 | 5/2005 | Goodwin | |
| 2006/0010717 | A1 | 1/2006 | Finkelstein | |
| 2006/0021251 | A1 | 2/2006 | Swigart et al. | |
| 2006/0225304 | A1 | 10/2006 | Goodwin | |
| 2006/0230636 | A1 | 10/2006 | Kokstis et al. | |
| 2007/0251122 | A1 | 11/2007 | Snow et al. | |
| 2008/0016717 | A1 | 1/2008 | Ruban | |
| 2008/0148598 | A1 | 6/2008 | Schoenborn | |
| 2008/0189986 | A1 | 8/2008 | Elnekaveh | |
| 2008/0244934 | A1 | 10/2008 | Covatch | |
| 2010/0180466 | A1 | 7/2010 | Ho | |
| 2010/0218397 | A1 * | 9/2010 | Nishiwaki | A43B 13/125 36/28 |
| 2011/0197470 | A1 | 8/2011 | Caron et al. | |
| 2011/0214313 | A1 | 9/2011 | James et al. | |
| 2011/0277347 | A1 | 11/2011 | Monfils et al. | |
| 2011/0277916 | A1 | 11/2011 | Beye et al. | |
| 2012/0159814 | A1 | 6/2012 | Smith et al. | |
| 2012/0216943 | A1 | 8/2012 | Rapaport et al. | |
| 2012/0233878 | A1 | 9/2012 | Hazenberg et al. | |
| 2013/0232818 | A1 | 9/2013 | Wiener | |
| 2013/0232825 | A1 | 9/2013 | Wiener et al. | |
| 2013/0247422 | A1 | 9/2013 | Holt et al. | |
| 2014/0223768 | A1 | 8/2014 | Berend et al. | |
| 2015/0013190 | A1 * | 1/2015 | Davison | A43B 13/186 36/102 |
| 2015/0040433 | A1 | 2/2015 | Hopmann et al. | |
| 2015/0113829 | A1 | 4/2015 | Kodad | |
| 2015/0374070 | A1 | 12/2015 | Tawney et al. | |
| 2016/0000187 | A1 | 1/2016 | Chon et al. | |
| 2016/0081428 | A1 | 3/2016 | Swigart et al. | |
| 2016/0143392 | A1 | 5/2016 | Peyton et al. | |
| 2017/0086532 | A1 | 3/2017 | Youngs | |
| 2017/0347747 | A1 | 12/2017 | Groeneweg et al. | |
| 2018/0064207 | A1 | 3/2018 | Hurd et al. | |
| 2018/0064208 | A1 | 3/2018 | Hurd et al. | |
| 2018/0332924 | A1 | 11/2018 | Bailey et al. | |
| 2018/0332925 | A1 | 11/2018 | Bailey et al. | |
| 2019/0365038 | A1 | 12/2019 | Auyang et al. | |
| 2019/0365039 | A1 | 12/2019 | Auyang et al. | |
| 2019/0365040 | A1 | 12/2019 | Auyang et al. | |
| 2020/0037705 | A1 | 2/2020 | Frank et al. | |
| 2020/0205514 | A1 | 7/2020 | VanDomelen | |
| 2020/0305549 | A1 | 10/2020 | Bailly et al. | |
| 2020/0375310 | A1 | 12/2020 | Aaron et al. | |
| 2022/0125160 | A1 | 4/2022 | Flores et al. | |

FOREIGN PATENT DOCUMENTS

| | | | |
|---|---|---|---|
| CN | 1849082 | A | 10/2006 |
| CN | 101677652 | A | 3/2010 |
| CN | 101982130 | A | 3/2011 |
| CN | 102202537 | A | 9/2011 |
| CN | 102349727 | A | 2/2012 |
| CN | 102669881 | A | 9/2012 |
| CN | 102726886 | A | 10/2012 |
| CN | 103179872 | A | 6/2013 |
| CN | 103313623 | A | 9/2013 |
| CN | 103533856 | A | 1/2014 |
| CN | 104203029 | A | 12/2014 |
| CN | 104287294 | A | 1/2015 |
| CN | 104640468 | A | 5/2015 |
| CN | 105615128 | A | 6/2016 |
| CN | 110074510 | A | 8/2019 |
| CN | 110381765 | A | 10/2019 |
| CN | 111972776 | A | 11/2020 |
| CN | 112293857 | A | 2/2021 |
| DE | 19641842 | A1 | 4/1998 |
| DE | 102011109274 | A1 | 2/2013 |
| EP | 1579778 | A1 | 9/2005 |
| EP | 3081110 | A2 | 10/2016 |
| FR | 2377166 | A1 | 8/1978 |
| FR | 2958508 | A1 | 10/2011 |
| KR | 200400222 | Y1 | 11/2005 |
| KR | 20100056052 | A | 5/2010 |
| TW | M596536 | U | 6/2020 |
| TW | 202126208 | A | 7/2021 |
| TW | 202211832 | A | 4/2022 |
| WO | 9209214 | A1 | 6/1992 |
| WO | 9809546 | A1 | 3/1998 |
| WO | 0170062 | A2 | 9/2001 |
| WO | 2010057207 | A2 | 5/2010 |
| WO | 2012154360 | A2 | 11/2012 |
| WO | 2015145329 | A1 | 10/2015 |
| WO | 2017053654 | A1 | 3/2017 |

* cited by examiner

ARTICLE OF FOOTWEAR WITH STACKED FOREFOOT BLADDERS

CROSS-REFERENCE TO RELATED APPLICATIONS

This application claims the benefit of priority to U.S. Provisional Application No. 63/403,027, filed Sep. 1, 2022 which is incorporated by reference in its entirety.

TECHNICAL FIELD

The present disclosure generally relates to an article of footwear that includes a sole structure having stacked forefoot cushioning components that include bladders.

BACKGROUND

A sole structure for an article of footwear is typically configured to provide cushioning, motion control, and/or resilience. Some sole structures include cushioning components that include a bladder forming a sealed interior cavity filled with fluid such as a gas that resiliently reacts a compressive load. A tensile component may be disposed in the interior cavity and may limit the outward expansion of the bladder.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
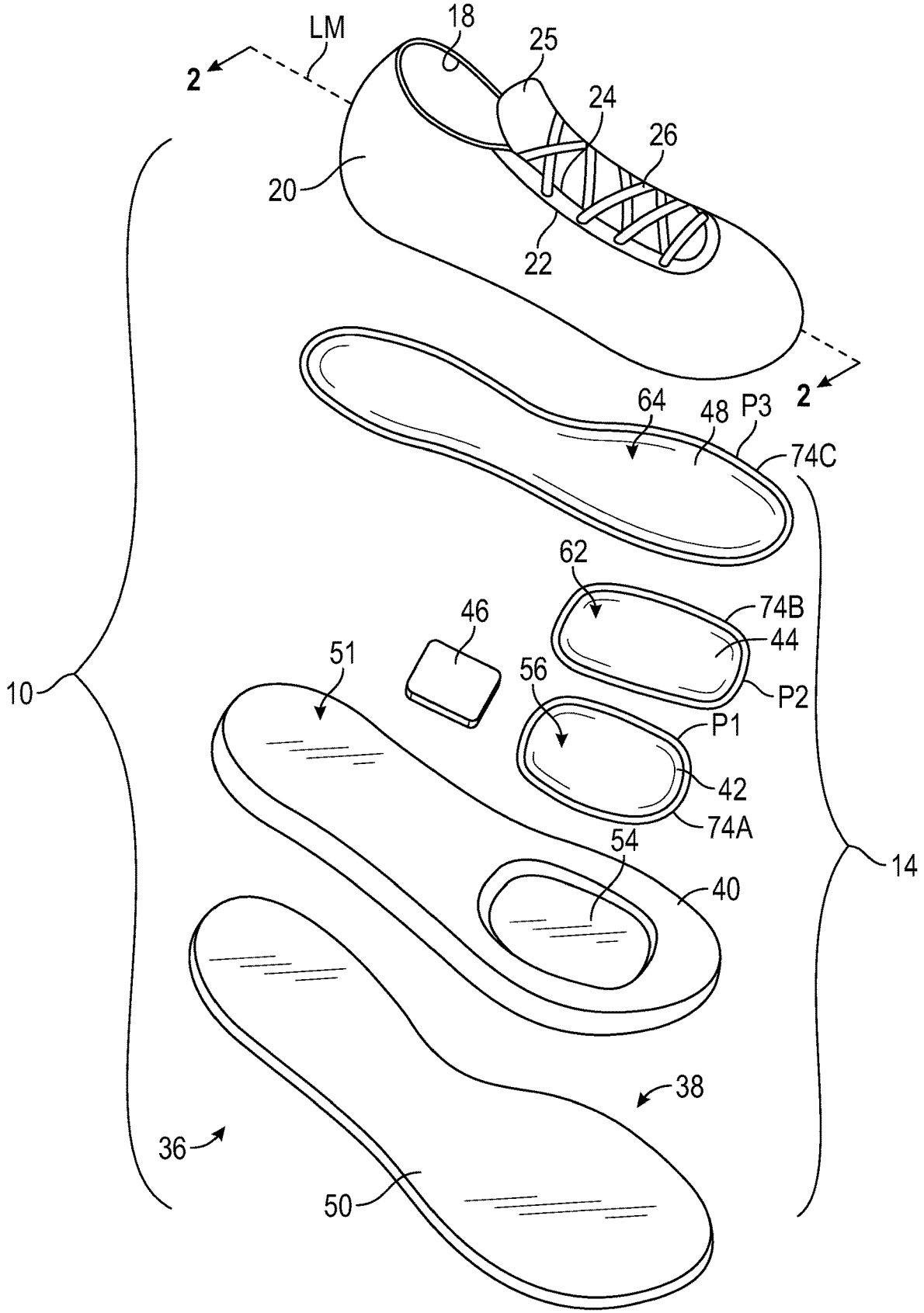
FIG. 1 is an exploded view of an article of footwear within the scope of the present teachings, including an upper and a sole structure.

The present disclosure generally relates to an article of footwear that utilizes stacked forefoot cushioning components that may each include a bladder with a gas-retaining interior cavity housing a tensile component. The forefoot cushioning components may be stacked on one another over a foam midsole layer in order to provide desired cushioning and impact protection. For example, a first forefoot cushioning component may be at the foot-facing surface of the foam midsole layer, and the second forefoot cushioning component may overlay the first forefoot cushioning component. A strobel may overlay the second forefoot cushioning component. A plate may be included in a midfoot region of the sole structure. These, and other features, provide responsiveness and motion control as discussed herein.

In an example, an article of footwear comprises a sole structure that has a forefoot region, a midfoot region, and a heel region. The sole structure may include a midsole layer, a first forefoot cushioning component, a second forefoot cushioning component, and a strobel. The foam midsole layer may have a foot-facing surface extending in each of the forefoot region and the midfoot region, and a ground-facing surface extending in each of the forefoot region and the midfoot region. The first forefoot cushioning component may be secured to the foot-facing surface of the foam midsole layer in the forefoot region. The second forefoot cushioning component may be stacked on the first forefoot cushioning component. The strobel may extend at least in the forefoot region and the midfoot region and over the second forefoot cushioning component. In some embodiments, the foam midsole layer and the strobel may also extend in the heel region.

Each of the first forefoot cushioning component, the second forefoot cushioning component, and the strobel includes a bladder that encloses an interior cavity and retains a gas in the interior cavity. Accordingly, in the forefoot region, in addition to the midsole layer, three top-loaded bladders are effectively provided to affect the cushioning profile.

In one or more embodiments, at least one of the first forefoot cushioning component, the second forefoot cushioning component, and the strobel may include a tensile component disposed in the interior cavity. The tensile component may include tensile layers and a plurality of tethers connecting the tensile layers. The tensile layers may be connected to an inner surface of the bladder such that the tethers span across the interior cavity. Optionally, each of the first forefoot cushioning component, the second forefoot cushioning component, and the strobel may include such a tensile component.

In an example, the bladder of each of the first forefoot cushioning component, the second forefoot cushioning component, and the strobel may include a first polymeric sheet and a second polymeric sheet bonded to the first polymeric sheet to enclose the interior cavity.

In one or more embodiments, the midsole layer may have a top recess in the foot-facing surface in the forefoot region. The first forefoot cushioning component may be disposed within the top recess. The second forefoot cushioning component may interface with a top surface of the first forefoot cushioning component and also with the foot-facing surface of the midsole layer forward of the first forefoot cushioning component. The top recess helps to locate the first forefoot cushioning component and allows it to be at least partially nested in the foam midsole layer.

Similarly, the second forefoot cushioning component may interface with the first forefoot cushioning component and extend further forward than the first forefoot cushioning component such that a forward extent of the second forefoot cushioning component interfaces with the foot-facing surface of the foam midsole layer forward of the first forefoot cushioning component.

In one or more embodiments, the sole structure may include a plate disposed at the foam midsole layer in the midfoot region. In some implementations, the plate may be a shank and may be disposed only in the midfoot region. The plate may be overlaid on the foot-facing surface of the midsole layer. The foam midsole layer may include a recess at the foot-facing surface or the ground-facing surface and in which the plate is disposed. In embodiments in which the plate is disposed at the foot-facing surface of the foam midsole layer, the strobel may overlie the plate. The plate may be relatively stiff in comparison to the foam midsole layer, and so may act to stabilize the sole structure to aid in a jumping motion, preventing excessive bending of the sole structure at the plate.

The sole structure may also include an outsole underlying the foam midsole layer and establishing a ground-engaging surface of the article of footwear.

In an example, an article of footwear comprises a sole structure that has a forefoot region, a midfoot region, and a heel region. The sole structure includes a foam midsole layer having a foot-facing surface extending in each of the forefoot region, the midfoot region, and the heel region, and a ground-facing surface extending in each of the forefoot region, the midfoot region, and the heel region. The sole structure further includes a plate disposed at the midsole layer only in the midfoot region, a first forefoot cushioning component secured to the foot-facing surface of the foam midsole layer in the forefoot region, and a second forefoot cushioning component stacked on the first forefoot cushioning component. Each of the first forefoot cushioning component and the second forefoot cushioning component includes a bladder that encloses an interior cavity and retains a gas in the interior cavity, and each also includes a tensile component disposed in the interior cavity. The tensile component includes tensile layers and a plurality of tethers connecting the tensile layers. The tensile layers are connected to an inner surface of the bladder such that the tethers span across the interior cavity.

In one or more embodiments, the plate is entirely rearward of the first forefoot cushioning component and the second forefoot cushioning component.

In one or more embodiments, a strobel extends in each of the forefoot region, the midfoot region, and the heel region, and extends over both the second forefoot cushioning component and the plate. The strobel also includes a bladder that encloses an interior cavity and retains a gas in the interior cavity, and a tensile component disposed in the interior cavity. The tensile component includes tensile layers and a plurality of tethers connecting the tensile layers. The tensile layers are connected to an inner surface of the bladder such that the tethers span across the interior cavity.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

Figure 2:
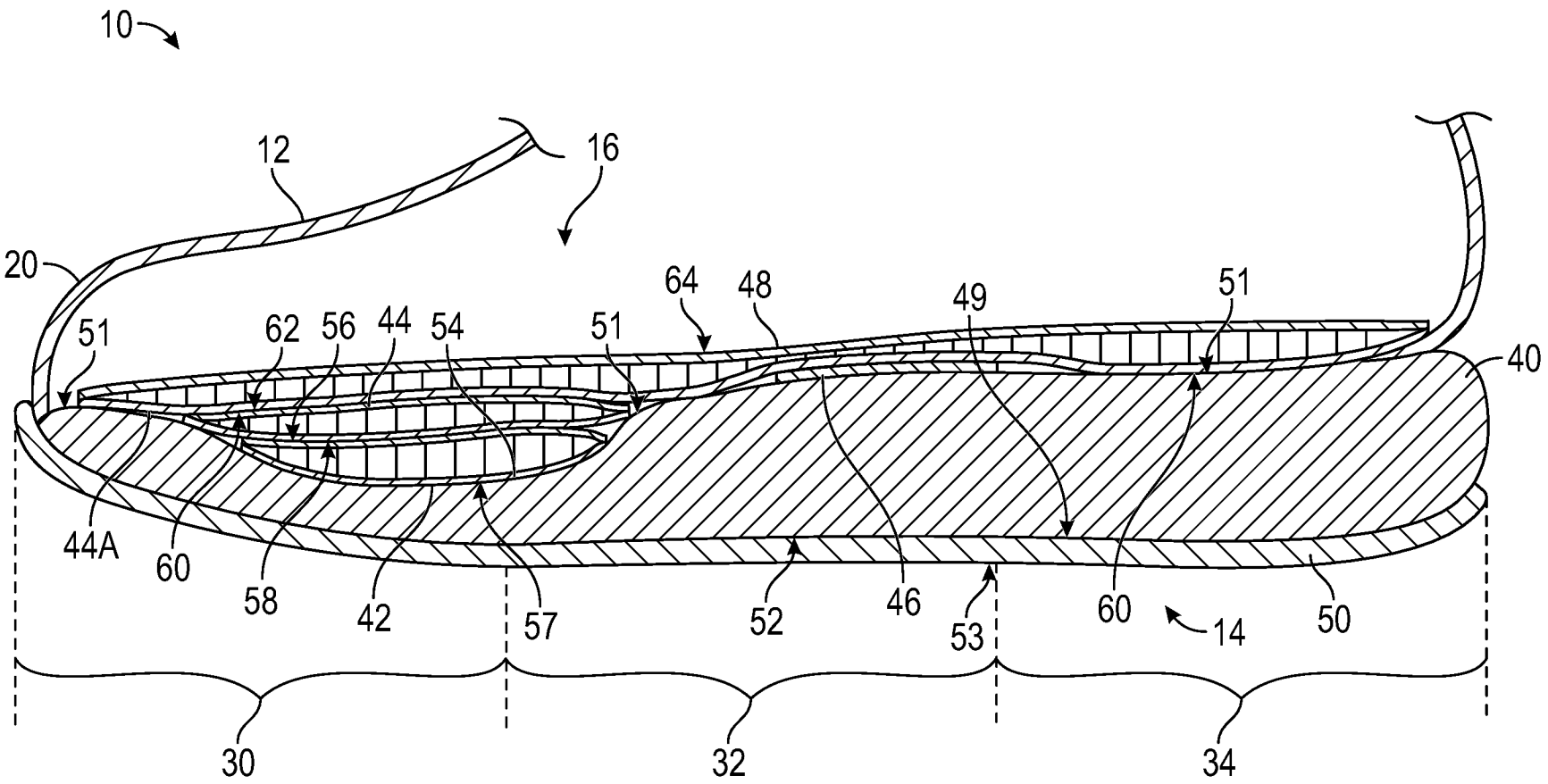
FIG. 2 is a cross-sectional view of the article of footwear of FIG. 1 taken at lines 2-2.

FIG. 1 is an exploded view of an article of footwear 10 including an upper 12 and a sole structure 14. As shown in FIG. 2, the upper 12 is secured to the sole structure 14 to define a foot-receiving cavity 16 in which a foot may be received through an ankle opening 18 (see FIG. 1) of the upper 12 and supported on the sole structure 14. The upper 12 is shown as including a body 20 with an eyestay 22 defining a throat opening 24, and including a tongue 25. The upper 12 is also shown as including a tensioning element, such as an elastic lace 26, to adjust the body 20 over the foot. However, the upper 12 is merely exemplary, and other configurations of uppers may be used within the scope of the disclosure, such as an upper configured as a sock or a bootie, an upper with a "high top" configuration that has an ankle portion extending higher on the leg of the wearer, etc.

The upper 12 may be a variety of materials, such as leather, textiles, polymers, cotton, foam, composites, etc., or combinations of these. For example, the body 20 may be a polymeric material capable of providing elasticity, and may be of a braided construction, a knitted (e.g., warp-knitted) construction, or a woven construction. A lower extent of the body 20 of the upper 12 is secured to a periphery of the sole structure 14 as shown in FIG. 2.

With reference to FIG. 2, the article of footwear 10 as well as the upper 12 and the sole structure 14 may be divided into a forefoot region 30, a midfoot region 32, and a heel region 34. The forefoot region 30 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 32 generally includes portions of the article of footwear 10 corresponding with the arch area and instep of the foot, and the heel region 34 corresponds with rear portions of the foot, including the calcaneus bone. The forefoot region 30, the midfoot region 32, and the heel region 34 are not intended to demarcate precise areas of the article of footwear 10, but are instead intended to represent general areas of the article of footwear 10 to aid in the following discussion.

The article of footwear 10 has a lateral side 36 and a medial side 38, indicated in FIG. 1. The lateral side 36 and the medial side 38 extend through each of the forefoot region 30, the midfoot region 32, and the heel region 34, and correspond with opposite sides of the article of footwear 10, each falling on an opposite side of a longitudinal midline (LM) of the article of footwear 10, also indicated in FIG. 1. The lateral side 36 is thus considered to be opposite from the medial side 38. The article of footwear 10 as shown is configured for a right foot. An article of footwear configured for a left foot may be a mirror image of the article of footwear 10.

The sole structure 14 includes a foam midsole layer 40, a first forefoot cushioning component 42, a second forefoot cushioning component 44, a plate 46, a strobel 48, and an outsole 50, all of which are discussed further herein. Briefly, with reference to FIG. 2, the foam midsole layer 40 is an integral, unitary, one-piece component that supports each of the forefoot cushioning components 42 and 44, as well as the plate 46 and the strobel 48. The foam midsole layer 40 thus establishes the relative positions of the forefoot cushioning components 42 and 44, the plate 46, and the strobel 48, ensuring that the components function as a midsole system having various beneficial properties discussed herein.

The foam midsole layer 40 may be at least partially a polyurethane foam, or a polyurethane ethylene-vinyl acetate (EVA) foam and may include heat-expanded and molded EVA foam pellets. The foam midsole layer 40 may generally include phylon (ethylene vinyl acetate or "EVA") and/or polyurethane ("PU") base resins. For example, in one embodiment, the foam midsole layer 40 may be a compression molded phylon. If EVA is used, it may have a vinyl acetate (VA) level between approximately 9% and approximately 40%. Suitable EVA resins include Elvax®, provided by E. I. du Pont de Nemours and Company, and Engage™ provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

Figure 3:
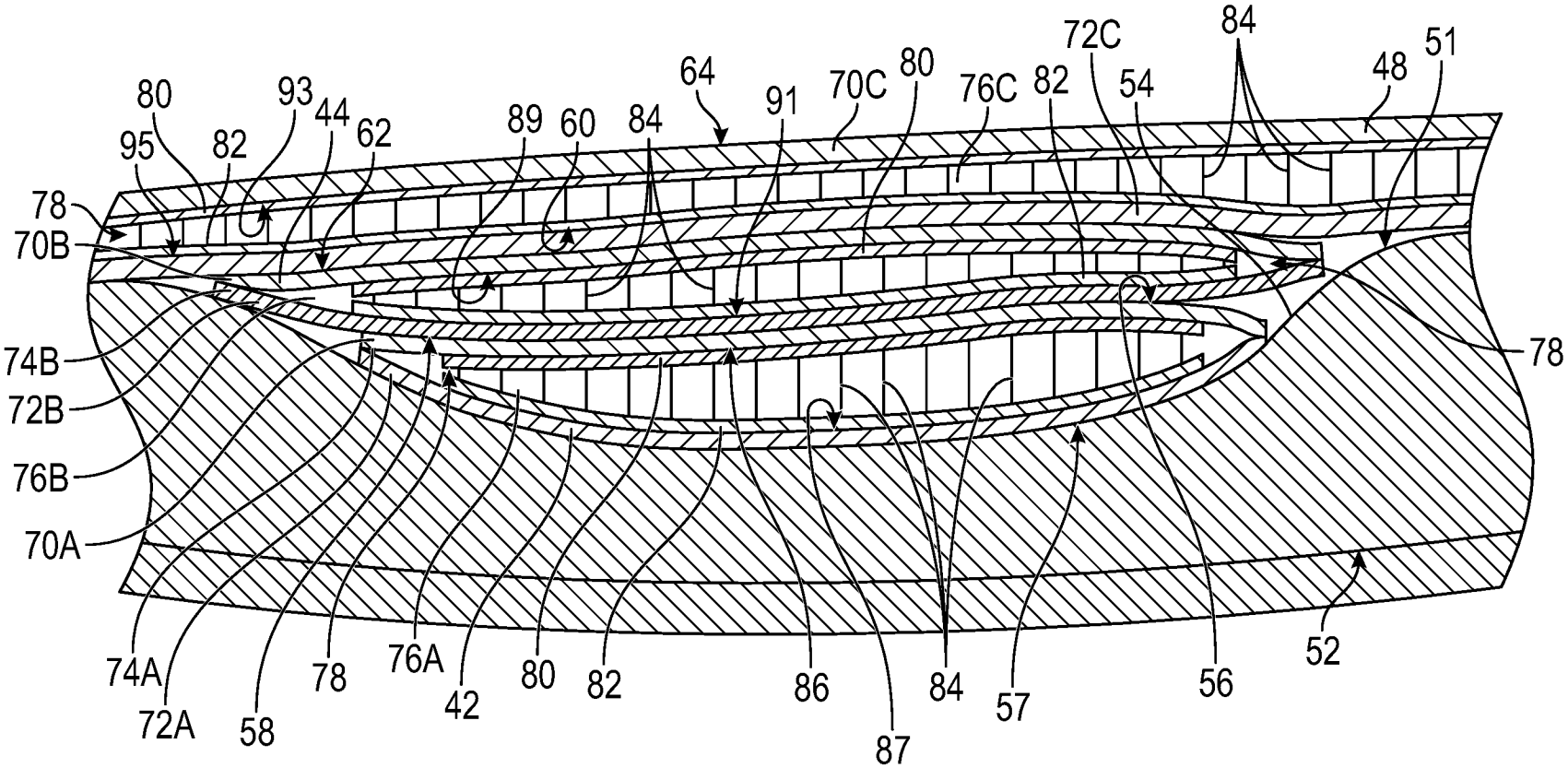
FIG. 3 is a close-up fragmentary view of a portion of FIG. 2.

As shown in FIGS. 2-3, the foam midsole layer 40 has a foot-facing surface 51 and a ground-facing surface 52. The foot-facing surface 51 and the ground-facing surface 52 extend in each of the forefoot region 30, the midfoot region 32, and the heel region 34.

FIG. 1 shows the outsole 50 as a unitary, integral, one-piece component. The outsole 50 underlies the foam midsole layer 40 and is secured to the bottom surface 52 thereof to establish a ground-engaging surface 53 of the sole structure 14, as shown in FIG. 2. The outsole 50 has a foot-facing surface 49 (also referred to as an inner surface or top surface) on which the ground-facing surface 52 of the foam midsole layer 40 rests and is secured such as by thermal bonding and/or with adhesive, or otherwise. The outsole has a bottom surface 53, which is also a ground-engaging surface of the sole structure 14 and the article of footwear 10.

The outsole 50 may be formed from materials that may generally include natural or synthetic rubber or other suitably durable materials. The material or materials for the outsole 50 may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber.

The foam midsole layer 40 has a top recess 54 in the foot-facing surface 51 in the forefoot region 30 as best shown in FIG. 1. The first forefoot cushioning component 42 is disposed within the top recess 54 and carried by the foam midsole layer 40 therein, as shown in FIG. 2. The top recess 54 may be shaped to follow a perimeter P1 of the first forefoot cushioning component 42, as is evident in FIG. 1. The top recess 54 helps to locate the first forefoot cushioning component 42 relative to the foam midsole layer 40 and allows it to be at least partially nested in the foam midsole layer 40.

The first forefoot cushioning component 42 is disposed within the top recess 54 and is secured to the foot-facing surface 51 of the foam midsole layer 40 at a bottom surface 57 of the first forefoot cushioning component 42 in the top recess 54, such as by thermal bonding and/or with adhesive, or otherwise.

Although not shown, in some embodiments, the top recess 54 may have an undercut at the perimeter thereof so that, when the first forefoot cushioning component 42 is received in the top recess 54, at least a portion of the perimeter P1 may be tucked within the undercut with an outer top edge of the recess 54 extending over the first forefoot cushioning component 42 and that portion of the perimeter P1 therefore not exposed at the foot-facing surface 51.

The second forefoot cushioning component 44 overlays the first forefoot cushioning component 42 and is stacked directly thereon. More specifically, in the embodiment shown, a bottom surface 58 of the second forefoot cushioning component 44 interfaces with a top surface 56 of the first forefoot cushioning component and with the foot-facing surface 51 of the foam midsole layer 40 forward of the first forefoot cushioning component 42. Stated differently, the second forefoot cushioning component 44 interfaces with the first forefoot cushioning component 42 and extends further forward than the first forefoot cushioning component 42 such that a forward extent 44A of the second forefoot cushioning component 44 interfaces with the foot-facing surface 51 of the foam midsole layer 40 forward of the first forefoot cushioning component 42.

The strobel 48 is shown as a "full-length" strobel, meaning that, like the foam midsole layer 40, it extends in each of the forefoot region 30, the midfoot region 32, and the heel region 34. In other embodiments, the strobel 48 may extend only in the forefoot region 30 and the midfoot region 32. As shown, the strobel 48 extends over the second forefoot cushioning component 44 and the foam midsole layer 40. For example, a bottom surface 60 of the strobel 48 may be bonded to each of a top surface 62 of the second forefoot cushioning component 44 and the foot-facing surface 51 of the foam midsole layer 40.

As such, the stacked first forefoot cushioning component 42 and second forefoot cushioning component 44 may be referred to as top-loaded because compressive forces thereon, such as by loading of the foot, will load the forefoot cushioning components 42 and 44 through the strobel 48 without the foam midsole layer 40 therebetween. Stated differently, at least at the recess 54, the first and second forefoot cushioning components 42 and 44 are closer to the foot than is the foam midsole layer 40.

The top recess 54 may have a depth less than or equal to an inflated height of portions of the stacked first and second forefoot cushioning components 42, 44 so that the stacked first and second forefoot cushioning components 42 and 44 largely fill the top recess 54 and the top surface 62 of the second forefoot cushioning component 44 extends generally level with or slightly above surrounding portions of the foot-facing surface 51 of the foam midsole layer 40. The strobel 48 overlies the second forefoot cushioning component 44 to support portions of the foot on the top surface 64 thereof. The top surface 64 of the strobel 48 is the foot-receiving surface of the sole structure 14. Alternatively, a sock liner or other component may extend over the strobel 48 and define the foot-facing surface of the sole structure 14. The forefoot cushioning components 42, 44 are not exposed at the lateral side 36 or the medial side 38 of the article of footwear 10 in the embodiment shown. For example, only the upper 12, the foam midsole layer 40, and the outsole 50 are visible from a vantage point external to the article of footwear.

Each of the first forefoot cushioning component 42, the second forefoot cushioning component 44, and the strobel 48 includes a respective bladder that encloses an interior cavity and retains a gas in the interior cavity. More specifically, each of the first forefoot cushioning component 42, the second forefoot cushioning component 44, and the strobel 48 includes a separate bladder that may be formed from two polymeric sheets as discussed herein. Accordingly, in the forefoot region 30, in addition to the foam midsole layer 40, three top-loaded bladders are effectively provided to affect the cushioning profile. In an example, the bladder of each of the first forefoot cushioning component 42, the second forefoot cushioning component 44, and the strobel 48 may include a first polymeric sheet and a second polymeric sheet bonded to the first polymeric sheet to enclose the interior cavity.

For example, with reference to FIG. 3, the first forefoot cushioning component 42 includes a first polymeric sheet 70A and a second polymeric sheet 72A bonded to one another at a peripheral flange 74A (best indicated in FIG. 1) to enclose an interior cavity 76A. The peripheral flange 74A may extend around the entire periphery of the first forefoot cushioning component 42 and define the outer perimeter P1 thereof as shown in FIG. 1. The first polymeric sheet 70A may be referred to as a top sheet and defines the top surface 56. The second polymeric sheet 72A may be referred to as a bottom sheet and defines the bottom surface 57. The bonded polymeric sheets 70A, 72A may be referred to as a first bladder or simply as a bladder.

The second forefoot cushioning component 44 also includes a first polymeric sheet 70B and a second polymeric sheet 72B bonded to one another at a peripheral flange 74B to enclose an interior cavity 76B. The peripheral flange 74B may extend around the entire periphery of the second forefoot cushioning component 44 and define an outer perimeter P2 thereof as shown in FIG. 1. The first polymeric sheet 70B may be referred to as a top sheet and defines the top surface 62. The second polymeric sheet 72B may be referred to as a bottom sheet and defines the bottom surface 58. The bonded sheets 70B, 72B may be referred to as a second bladder or simply as a bladder.

Similarly, the strobel 48 includes a first polymeric sheet 70C and a second polymeric sheet 72C bonded to one another at a peripheral flange 74C (see FIG. 1) to enclose an interior cavity 76C. The peripheral flange 74C may extend around the entire periphery of the strobel 48 and defines an outer perimeter P3 thereof as shown in FIG. 1. The first polymeric sheet 70C may be referred to as a top sheet and defines the top surface 64. The second polymeric sheet 72C may be referred to as a bottom sheet and defines the bottom surface 60. The bonded polymeric sheets 70C, 72C may be referred to as a third bladder or simply as a bladder.

Each of the first forefoot cushioning component 42, the second forefoot cushioning component 44, and the strobel 48 encloses an interior cavity 76A, 76B, and 76C, respectively, and retains a gas in the respective interior cavity 76A, 76B, and 76C. When the polymeric sheets 70A, 72A, are bonded to one another at the peripheral flange 74A and any inflation port is sealed, the polymeric sheets 70A, 72A define a first bladder that retains a fluid (e.g., a gas) in the interior cavity 76A. When the polymeric sheets 70B, 72B, are bonded to one another at the peripheral flange 74B and any inflation port is sealed, the polymeric sheets 70B, 72B define a second bladder that retains a fluid (e.g., a gas) in the interior cavity 76B. When the polymeric sheets 70C, 72C, are bonded to one another at the peripheral flange 74C and any inflation port is sealed, the polymeric sheets 70C, 72C define a third bladder that retains a fluid (e.g., a gas) in the interior cavity 76C. The interior cavities 76A, 76B, and 76C are not in fluid communication with one another. This enables the internal cavities 76A, 76B, and 76C to retain gas at different inflation pressures. Alternatively, one or more of the internal cavities 76A, 76B, and 76C may be at ambient pressure. In still another alternative, the internal cavities 76A, 76B, and 76C could be at the same inflation pressure.

As used herein, a "fluid" filling the respective interior cavities 76A, 76B, and 76C may be a gas, such as air, nitrogen, another gas, or a combination thereof. The first and second polymeric sheets 70A, 72A, 70B, 72B, and 70C, 72C of the first forefoot cushioning component 42, the second forefoot cushioning component 44, and the strobel 48, respectively, can be a variety of polymeric materials that can resiliently retain a fluid such as nitrogen, air, or another gas. Examples of polymeric materials for the first and second polymeric sheets 70A, 72A, 70B, 72B, and 70C, 72C include thermoplastic urethane, polyurethane, polyester, polyester polyurethane, and polyether polyurethane. Moreover, any or all of the first and second polymeric sheets 70A, 72A, 70B, 72B, and 70C, 72C can each be formed of layers of different materials including polymeric materials. In one embodiment, each of the first and second polymeric sheets 70A, 72A, 70B, 72B, and 70C, 72C is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the first and second polymeric sheets 70A, 72A, 70B, 72B, and 70C, 72C are disclosed in U.S. Pat. Nos. 4,183,156 and 4,219,945 to Rudy which are incorporated by reference in their entireties. Further suitable materials for the first and second polymeric sheets 70A, 72A, 70B, 72B, and 70C, 72C include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the first and second forefoot cushioning components 42, 44 and for the strobel 48, engineering properties such as tensile strength, stretch properties, fatigue characteristics, dynamic modulus, and loss tangent can be considered. For example, the thicknesses of the first and second polymeric sheets 70A, 72A, 70B, 72B, and 70C, 72C used to form the first and second forefoot cushioning components 42, 44 and the strobel 48, respectively, can be selected to provide these characteristics.

Any one or more of the first forefoot cushioning component 42, the second forefoot cushioning component 44, and the strobel 48 may include a tensile component 78 disposed in the respective interior cavity 76A, 76B, and 76C. In the embodiment of FIGS. 1-3, each of the interior cavities 76A, 76B, and 76C has a respective tensile component 78 disposed therein.

With reference to FIG. 3, each tensile component 78 includes tensile layers 80, 82, and a plurality of tethers 84 connecting the tensile layers 80, 82. The tensile layers 80, 82 are connected to top and bottom portions of an inner surface of the respective bladders formed by the polymeric sheets 70A, 72A, 70B, 72B, and 70C, 72C, respectively, such that the tethers 84 span across the respective interior cavity 76A, 76B, and 76C. In the first forefoot cushioning component 42, the tensile layer 80 is bonded to an inner surface 86 of the top polymeric sheet (first polymeric sheet 70A) and the tensile layer 82 is bonded to an inner surface 87 of the bottom polymeric sheet (second polymeric sheet 72A). Only some of the tethers 84 are indicated with reference numbers in FIG. 3. The tethers 84 may also be referred to as fabric tensile members, or threads, and may be in the form of drop threads that connect the first tensile layer 80 and the second tensile layer 82. The tensile component 78 may be formed as a unitary, one-piece textile element having a spacer-knit textile.

The tethers 84 restrain separation of the first and second polymeric sheets 70A, 72A to the maximum separated positions shown in FIG. 3 under a given inflation pressure of gas in the interior cavity 76A. The outward force of pressurized gas in the interior cavity 76A places the tethers 84 in tension, and the tethers 84 prevent the tensile layers 80, 82 and polymeric sheets 70A, 72A from further outward movement away from one another. However, the tethers 84 do not present resistance to compression when under a compressive load. When pressure is exerted on the first forefoot cushioning component 42 such as due to a force of a dynamic impact of a wearer during running or other movements, the first forefoot cushioning component 42 is compressed, and the polymeric sheets 70A, 72A move closer together with the tethers 84 collapsing (i.e., going slack) in proportion to the pressure exerted on the first and second polymeric sheets 70A, 72A adjacent the particular tethers 84, and then regain their extended lengths when the dynamic load is removed and the first and second polymeric sheets 70A, 72A move away from one another to the positions shown in FIG. 3.

With respect to the tensile component 78 disposed in the interior cavity 76B of the second forefoot cushioning component 44, the tensile layer 80 is bonded to an inner surface 89 of the top polymeric sheet (first polymeric sheet 70B) and the tensile layer 82 is bonded to an inner surface 91 of the bottom polymeric sheet (second polymeric sheet 72B). With respect to the tensile component 78 disposed in the interior cavity 76C of the strobel 48, the tensile layer 80 is bonded to an inner surface 93 of the top polymeric sheet (first polymeric sheet 70C) and the tensile layer 82 is bonded to an inner surface 95 of the bottom polymeric sheet (second polymeric sheet 72C).

With reference to FIG. 2, the plate 46 is disposed at the foam midsole layer 40 in the midfoot region 32. As shown, the plate 46 is a shank and is disposed only in the midfoot region 32. The plate is entirely rearward of the first forefoot cushioning component 42 and the second forefoot cushioning component 44. The plate 46 is overlain on the foot-facing surface 51 of the foam midsole layer 40, and the strobel 48 overlies the plate 46. The plate 46 is relatively flat. The plate 46 may be generally configured to extend substantially across the width of the foot-facing surface 51 of the foam midsole layer 40 in the midfoot region 32. In another example, such as in FIG. 5, the plate 46 may underlie the foam midsole layer 40 and may be configured to extend substantially across the width of the bottom surface 52 of the foam midsole layer 40 in the midfoot region 32.

The plate 46 is secured to the foam midsole layer 40 in the midfoot region 32 such as by thermal bonding and/or with adhesive, or otherwise. The plate 46 may be a thermoplastic polyurethane. In an example, the plate 46 may be a polyether block amide PEBAX Rnew 63R53 SP 01, a thermoplastic elastomer made of flexible polyether and rigid polyamide based on renewable resources and having an instantaneous hardness of 58 on a Shore D durometer test scale using the ISO 868 test method, and available from Arkema, Inc. in King of Prussia, Pennsylvania USA. In another example, the plate 46 may be PEBAX® Rnew 55R53 SP 01, also a thermoplastic elastomer made of flexible polyether and rigid polyamide based on renewable resources and having an instantaneous hardness of 50 on a Shore D durometer test scale using the ISO 868 test method and also available from Arkema, Inc. in King of Prussia, Pennsylvania USA.

The plate 46 has a greater bending stiffness than the foam midsole layer 40 and is positioned in the midfoot region 32 in order to limit twisting and folding in this region, and to provide rigidity to support the takeoff of a vertical jump. Stated differently, the plate 46 increases the bending stiffness of the sole structure 14 in the midfoot region 32.

Figure 4:
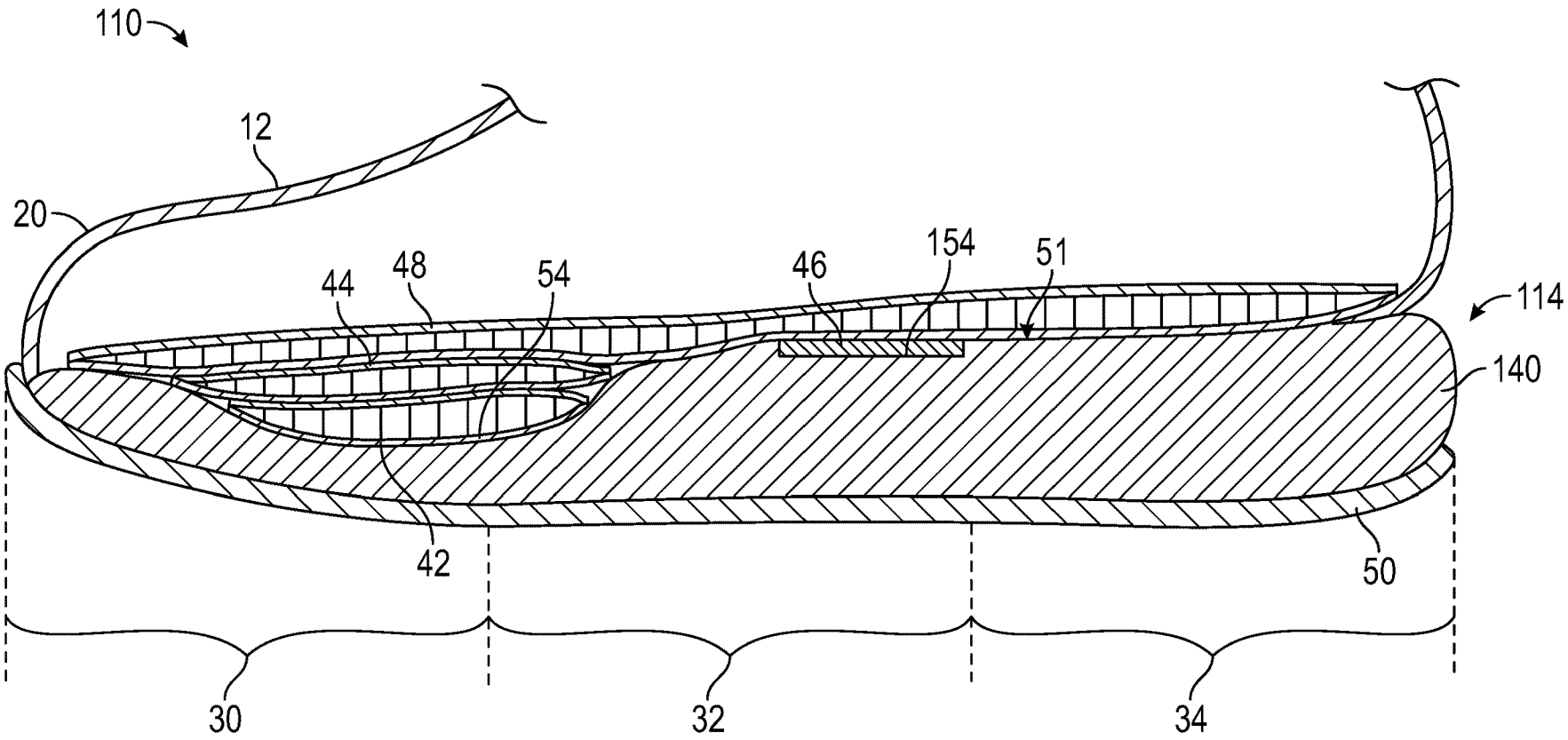
FIG. 4 is a cross-sectional view of an alternative embodiment of an article of footwear.

FIG. 4 shows another embodiment of an article of footwear 110 that is alike in all aspects to the article of footwear 10 except that the foam midsole layer 40 is replaced with a foam midsole layer 140 that has a recess 154 in the foot-facing surface 51 in the midfoot region 32, in addition to the recess 54 in the foot-facing surface 51 in the forefoot region 30. The recess 54 may be referred to as a first top recess and the recess 154 may be referred to as a second top recess. The plate 46 is disposed in the recess 154 and the strobel 48 overlies the plate 46 at the foot-facing surface 51 of the foam midsole layer 40. The foam midsole layer 140 is otherwise identical to the foam midsole layer 40 and the description herein of the foam midsole layer 40 applies equally to the foam midsole layer 140. The sole structure 114 of the article of footwear 110 includes the first forefoot cushioning component 42, the second forefoot cushioning component 44, the strobel 48, the plate 46, and the outsole 50 as described with respect to the sole structure 14, as well as the foam midsole layer 140.

Figure 5:
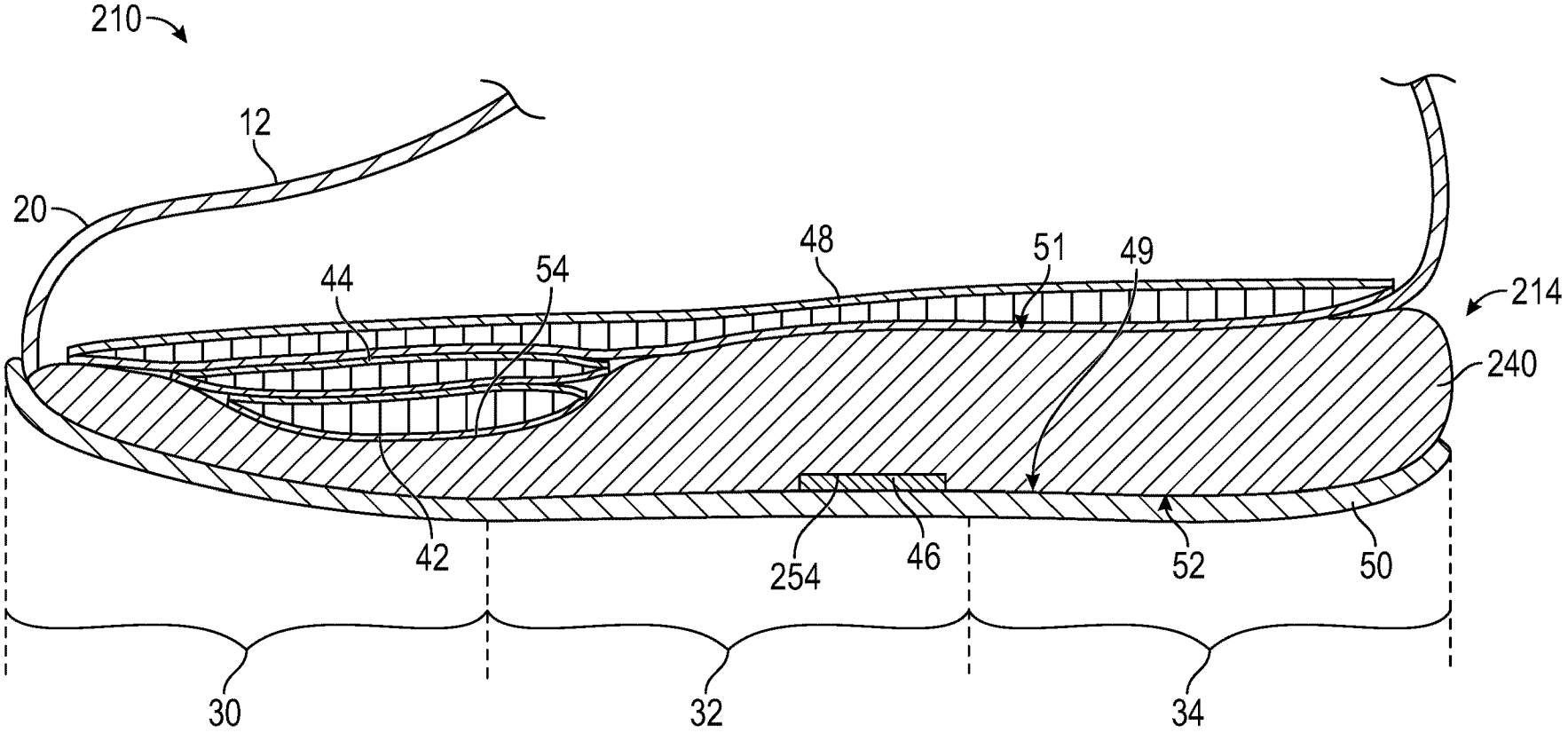
FIG. 5 is a cross-sectional view of another alternative embodiment of an article of footwear.

FIG. 5 shows another embodiment of an article of footwear 210 that is alike in all aspects to the article of footwear 10 except that the foam midsole layer 40 is replaced with a foam midsole layer 240 that has a recess 254 in the ground-facing surface 52 in the midfoot region 32 in addition to the recess 54 in the forefoot region 30 at the foot-facing surface 51. The plate 46 is disposed in the recess 254 and overlies the outsole 50. The plate 46 may be secured to the foam midsole layer 240 at the recess 254 and to the foot-facing surface 49 of the outsole 50. The foam midsole layer 240 is otherwise identical to the foam midsole layer 40 and the description herein of the foam midsole layer 40 applies equally to the foam midsole layer 240. The sole structure 214 of the article of footwear 210 includes the first forefoot cushioning component 42, the second forefoot cushioning component 44, the strobel 48, the plate 46, and the outsole 50 as described with respect to the sole structure 14, as well as the foam midsole layer 240. In some embodiments, the plate 46 may wrap upward from the ground-facing surface 52 onto a medial side wall of the foam midsole layer 240.

The following Clauses provide example configurations of an article of footwear disclosed herein.

Clause 1. An article of footwear comprising: a sole structure that has a forefoot region, a midfoot region, and a heel region, and the sole structure includes: a foam midsole layer having a foot-facing surface extending in each of the forefoot region and the midfoot region, and a ground-facing surface extending in each of the forefoot region and the midfoot region; a first forefoot cushioning component secured to the foot-facing surface of the foam midsole layer in the forefoot region; a second forefoot cushioning component stacked on the first forefoot cushioning component; and a strobel extending at least in the forefoot region and the midfoot region; wherein the strobel extends over the second forefoot cushioning component; and wherein each of the first forefoot cushioning component, the second forefoot cushioning component, and the strobel includes a bladder that encloses an interior cavity and retains a gas in the interior cavity.

Clause 2. The article of footwear of Clause 1, wherein: at least one of the first forefoot cushioning component, the second forefoot cushioning component, and the strobel includes a tensile component disposed in the interior cavity; and the tensile component includes tensile layers and a plurality of tethers connecting the tensile layers, the tensile layers connected to an inner surface of the bladder such that the tethers span across the interior cavity.

Clause 3. The article of footwear of any of the preceding Clauses, wherein: each of the first forefoot cushioning component, the second forefoot cushioning component, and the strobel includes a tensile component disposed in the interior cavity; and the tensile component includes tensile layers and a plurality of tethers connecting the tensile layers, the tensile layers connected to an inner surface of the bladder such that the tethers span across the interior cavity.

Clause 4. The article of footwear of any of the preceding Clauses, wherein: the foam midsole layer has a top recess in the foot-facing surface in the forefoot region; and the first forefoot cushioning component is disposed within the top recess.

Clause 5. The article of footwear of any of the preceding Clauses, wherein the second forefoot cushioning component interfaces with a top surface of the first forefoot cushioning component and with the foot-facing surface of the midsole layer forward of the first forefoot cushioning component.

Clause 6. The article of footwear of any of the preceding Clauses, the sole structure further comprising: a plate disposed at the midsole layer in the midfoot region.

Clause 7. The article of footwear of any of the preceding Clauses, wherein the plate is a shank and is disposed only in the midfoot region.

Clause 8. The article of footwear of any of the preceding Clauses, wherein the foam midsole layer includes a recess at one of the foot-facing surface and the ground-facing surface and in which the plate is disposed.

Clause 9. The article of footwear of any of the preceding Clauses, wherein the plate is overlaid on the foot-facing surface of the foam midsole layer.

Clause 10. The article of footwear of any of the preceding Clauses, wherein the strobel overlies the plate.

Clause 11. The article of footwear of any of the preceding Clauses, wherein the second forefoot cushioning component interfaces with the first forefoot cushioning component and extends further forward than the first forefoot cushioning component such that a forward extent of the second forefoot cushioning component interfaces with the foot-facing surface of the foam midsole layer forward of the first forefoot cushioning component.

Clause 12. The article of footwear of any of the preceding Clauses, the sole structure further comprising: an outsole underlying the foam midsole layer and establishing a ground-engaging surface of the article of footwear.

Clause 13. The article of footwear of any of the preceding Clauses, wherein the bladder of each of the first forefoot cushioning component, the second forefoot cushioning component, and the strobel includes a first polymeric sheet and a second polymeric sheet bonded to the first polymeric sheet to enclose the interior cavity.

Clause 14. The article of footwear of any of the preceding Clauses, wherein the foam midsole layer and the strobel extend in the heel region.

Clause 15. The article of footwear of any of the preceding Clauses, wherein the midsole layer is a one-piece component extending in each of the forefoot region, the midfoot region, and the heel region.

Clause 16. An article of footwear of any of the preceding Clauses comprising: a sole structure that has a forefoot region, a midfoot region, and a heel region, and the sole structure includes: a foam midsole layer having a foot-facing surface extending in each of the forefoot region, the midfoot region, and the heel region, and a ground-facing surface extending in each of the forefoot region, the midfoot region, and the heel region; a plate disposed at the foam midsole layer only in the midfoot region; a first forefoot cushioning component secured to the foot-facing surface of the midsole layer in the forefoot region; a second forefoot cushioning component stacked on the first forefoot cushioning component; wherein each of the first forefoot cushioning component and the second forefoot cushioning component includes: a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity.

Clause 17. The article of footwear of any of the preceding Clauses, wherein the plate is entirely rearward of the first forefoot cushioning component and the second forefoot cushioning component.

Clause 18. The article of footwear of any of the preceding Clauses, the sole structure further comprising: a strobel extending in each of the forefoot region the midfoot region, and the heel region, and extending over the second forefoot cushioning component and the plate; wherein the strobel includes a bladder that encloses an interior cavity and retains a gas in the interior cavity.

Clause 19. The article of footwear of any of the preceding Clauses, wherein the strobel includes a tensile component disposed in the interior cavity; wherein the tensile component includes tensile layers and a plurality of tethers connecting the tensile layers, the tensile layers connected to an inner surface of the bladder such that the tethers span across the interior cavity.

Clause 20. The article of footwear of any of the preceding Clauses, wherein the midsole layer is a one-piece component.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure that has a forefoot region, a midfoot region, and a heel region, and the sole structure includes:

a foam midsole layer having a foot-facing surface extending in each of the forefoot region and the midfoot region, and a ground-facing surface extending in each of the forefoot region and the midfoot region;

a first forefoot cushioning component secured to the foot-facing surface of the foam midsole layer in the forefoot region;

a second forefoot cushioning component stacked on the first forefoot cushioning component; and a strobel extending at least in the forefoot region and the midfoot region;

wherein the strobel extends over the second forefoot cushioning component;

wherein the second forefoot cushioning component interfaces with the first forefoot cushioning component and extends further forward than the first forefoot cushioning component such that a forward extent of the second forefoot cushioning component interfaces with the foot-facing surface of the foam midsole layer forward of the first forefoot cushioning component; and wherein each of the first forefoot cushioning component, the second forefoot cushioning component, and the strobel includes a bladder that encloses an interior cavity and retains a gas in the interior cavity.

2. The article of footwear of claim 1, wherein:

at least one of the first forefoot cushioning component, the second forefoot cushioning component, and the strobel includes a tensile component disposed in the interior cavity; and the tensile component includes tensile layers and a plurality of tethers connecting the tensile layers, the tensile layers connected to an inner surface of the bladder such that the tethers span across the interior cavity.

3. The article of footwear of claim 1, wherein:

each of the first forefoot cushioning component, the second forefoot cushioning component, and the strobel includes a tensile component disposed in the interior cavity; and the tensile component includes tensile layers and a plurality of tethers connecting the tensile layers, the tensile layers connected to an inner surface of the bladder such that the tethers span across the interior cavity.

4. The article of footwear of claim 1, wherein:

the foam midsole layer has a top recess in the foot-facing surface in the forefoot region; and the first forefoot cushioning component is disposed within the top recess.

5. The article of footwear of claim 4, wherein the second forefoot cushioning component interfaces with a top surface of the first forefoot cushioning component.

6. The article of footwear of claim 1, the sole structure further comprising:

a plate disposed at the foam midsole layer in the midfoot region.

7. The article of footwear of claim 6, wherein the plate is a shank and is disposed only in the midfoot region.

8. The article of footwear of claim 6, wherein the foam midsole layer includes a recess at one of the foot-facing surface and the ground-facing surface and in which the plate is disposed.

9. The article of footwear of claim 6, wherein the plate is overlaid on the foot-facing surface of the foam midsole layer.

10. The article of footwear of claim 6, wherein the strobel overlies the plate.

11. The article of footwear of claim 1, the sole structure further comprising:

an outsole underlying the foam midsole layer and establishing a ground-engaging surface of the article of footwear.

12. The article of footwear of claim 1, wherein the bladder of each of the first forefoot cushioning component, the second forefoot cushioning component, and the strobel includes a first polymeric sheet and a second polymeric sheet bonded to the first polymeric sheet to enclose the interior cavity.

13. The article of footwear of claim 1, wherein the foam midsole layer and the strobel extend in the heel region.

14. The article of footwear of claim 1, wherein the foam midsole layer is a one-piece component extending in each of the forefoot region, the midfoot region, and the heel region.

15. An article of footwear comprising:

a sole structure that has a forefoot region, a midfoot region, and a heel region, and the sole structure includes:

a foam midsole layer having a foot-facing surface extending in each of the forefoot region, the midfoot region, and the heel region, and a ground-facing surface extending in each of the forefoot region, the midfoot region, and the heel region;

a plate disposed in a recess of the foam midsole layer in the ground-facing surface of the foam midsole layer only in the midfoot region;

a first forefoot cushioning component secured to the foot-facing surface of the foam midsole layer in the forefoot region;

a second forefoot cushioning component stacked on the first forefoot cushioning component; and an outsole underlying the foam midsole layer and establishing a ground-engaging surface of the article of footwear;

wherein only the outsole interfaces with the ground-facing surface of the foam midsole layer in the forefoot region and in the heel region;

wherein each of the first forefoot cushioning component and the second forefoot cushioning component includes:

a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity; and wherein the second forefoot cushioning component interfaces with the first forefoot cushioning component and extends further forward than the first forefoot cushioning component such that a forward extent of the second forefoot cushioning component interfaces with the foot-facing surface of the foam midsole layer forward of the first forefoot cushioning component.

16. The article of footwear of claim 15, wherein the plate is entirely rearward of the first forefoot cushioning component and the second forefoot cushioning component.

17. The article of footwear of claim 15, the sole structure further comprising:

a strobel extending in each of the forefoot region, the midfoot region, and the heel region, and extending over the second forefoot cushioning component;

wherein the strobel includes a bladder that encloses an interior cavity and retains a gas in the interior cavity.

18. The article of footwear of claim 17, wherein the strobel includes a tensile component disposed in the interior cavity; wherein the tensile component includes tensile layers and a plurality of tethers connecting the tensile layers, the tensile layers connected to an inner surface of the bladder such that the tethers span across the interior cavity.

19. The article of footwear of claim 15, wherein the foam midsole layer is a one-piece component.

* * * * *